US011230894B1

(12) United States Patent
Shahid et al.

(10) Patent No.: US 11,230,894 B1
(45) Date of Patent: Jan. 25, 2022

(54) DRILLING TOOL LOADING CONTROL SYSTEM

(71) Applicants: Caterpillar Global Mining Equipment LLC, Denison, TX (US); Caterpillar Global Mining HMS GmbH, Dortmund (DE)

(72) Inventors: Ahsan Shahid, Peoria, IL (US); Carl John Moberg, Dunlap, IL (US); Timo Diekmann, Nordrhein Westphalen (DE)

(73) Assignee: Caterpillar Global Mining Equipment LLC., Denison, TX (US)

( * ) Notice: Subject to any disclaimer, the term of this patent is extended or adjusted under 35 U.S.C. 154(b) by 0 days.

(21) Appl. No.: 17/076,456

(22) Filed: Oct. 21, 2020

(51) Int. Cl.
*E21B 19/15* (2006.01)
*E21B 15/00* (2006.01)

(52) U.S. Cl.
CPC ..... *E21B 19/155* (2013.01); *E21B 15/003* (2013.01)

(58) Field of Classification Search
CPC ..... E21B 19/155; E21B 15/003; E21B 19/15; E21B 19/16; E21B 19/18; E21B 19/20
USPC ..... 414/22.51–22.71
See application file for complete search history.

(56) References Cited

U.S. PATENT DOCUMENTS 3,977,480 A 8/1976 Hilding
4,621,974 A 11/1986 Krueger
4,892,160 A * 1/1990 Schivley, Jr. ..... E21B 19/146 175/52
5,931,238 A 8/1999 Gilmore et al.
6,543,551 B1 4/2003 Sparks et al.
7,886,846 B2 2/2011 Pires
8,342,236 B2 * 1/2013 Bienfang ..... E21B 19/18 166/77.51
8,425,171 B2 * 4/2013 Mortensen ..... E21B 19/146 414/22.66
9,926,753 B2 * 3/2018 Magnuson ..... E21B 19/14
10,718,162 B2 * 7/2020 Van Duivendijk ..... E21B 19/08
2006/0162963 A1 7/2006 Hagemeyer et al.
2016/0090796 A1 * 3/2016 Roodenburg ..... E21B 19/155 414/22.66
2016/0201408 A1 7/2016 Little et al.

* cited by examiner

*Primary Examiner* — Lynn E Schwenning

(57) ABSTRACT

A pipe loading system for a blast hole drilling rig. The blast hole drilling rig includes a drilling platform, a drill tower supported on the drilling platform, a drill motor supported at an upper end of the drill tower, operatively coupled to a drilling head configured to selectively engage with and rotate a drill pipe, and a pipe loader pivotably supported on the drilling platform and configured to selectively index a drilling tool into coaxial alignment with the drill pipe during a drilling tool change-out operation. The pipe loader includes a pipe support pod at a lower end and a pipe holding clamp at an upper end. Sensors detect a presence of the drilling tool in the pipe holder, an interconnection between the drilling head and the drill pipe, and a state of the pipe holding clamp. The pipe loading system closes the pipe holding clamp when the drilling tool is in the pipe loader and the pipe holding clamp is not in a closed position.

20 Claims, 9 Drawing Sheets

DRILLING TOOL LOADING CONTROL SYSTEM

TECHNICAL FIELD

The present disclosure is directed to a system and method for controlling the automatic loading of drilling tools in a drill string on a blast hole drilling machine and, more particularly, a control strategy for automating operation of pipe loaders during drilling tool change-out operations on the drilling machine.

BACKGROUND

Excavating is employed to create mines, quarries, etc., in order to obtain desirable material such as ore or stone. In addition to using various types of heavy excavating equipment, drill-and-blast operations are commonly used to fragment material so it can be loaded and hauled. For example, overburden may need to be removed in order to reach the desirable material. Drill-and-blast operations may include drilling different types of blast holes to different depths.

Drilling systems are generally known to include a vertical drill tower (e.g. mast, etc.) constructed from structural members such as steel beams and reinforcing supports. The drill tower is often coupled to a mobile platform (e.g. having an operator's cab or the like, which along with other components typically form a drilling rig) for positioning the drill tower in a desired location to conduct a drilling operation. The drill tower is often equipped with a drill carousel which is structured and adapted to assist in assembly of a drill string formed from a combination of drill extenders (e.g. drill rods or drill pipes, referred to herein as "drilling tools"). The drilling tools may be selectively added to or removed from the drill string for drilling a hole having a desired depth. The drill carousel is intended to allow a drilling operation to progress into the drill hole by making readily available a continuous string of drilling tools as needed for advancing a drilling tool into a drill hole.

The initial (e.g. the first and therefore lowermost) drilling tool in the drill string is configured to receive a drill bit or hammering tool for fracturing substrate such as rock formations at its lower end during a drilling operation. After a certain amount of usage in the drilling operation it is often desirable to change (e.g. remove, replace, change-out, etc.) the drill bit or hammering tool due to (for example) accumulated wear, the need to change between a drill bit and a hammering tool (or vice versa), etc. Successive drilling tools may be threadedly engaged or disengaged with each other as each drilling tool is added to or removed from the drill string. One or more drilling tools may also need to be added or removed from a drill string in order to change the depth of a blast hole being bored by the drilling rig. In order to minimize downtime in the drilling operation due to change-out of drilling tools, mechanisms may be provided to facilitate removing one drilling tool from the end of the drilling string and replacing it with another drilling tool from a storage or supply location.

One example of such a mechanism is shown in U.S. Pat. No. 3,977,480, which generally shows a magazine for storing drill bits and a swingable arm to facilitate transfer of the drill bits between the magazine and the drill string. Another example of such a mechanism is shown in U.S. Patent Application Publication No. 2006/0162963, which generally shows a magazine for storing drill bits and a swingable arm having a rotatable carousel on one end to facilitate transfer of the drill bits between the magazine and the drill string. Another example is U.S. Pat. No. 7,886,846, which discloses a rotary carousel device. However, the disclosed mechanisms generally require a relatively large number of personnel and manual operation of the components to accomplish the replacement of drilling tools on a drill string.

There exists a need for a relatively simple and cost-effective drilling tool management system and method that occupies minimum space and automatically and effectively handles additional lengths of drill pipe or other drilling tools as it is installed and removed from a drill string. It would be both beneficial and desirable to provide a drilling tool control system and method that simplifies operator requirements while automatically controlling the addition and removal of drilling tools and ensuring that the various drilling tools and parts of the drilling rig do not interfere with each other while the drilling tool change-out operations are being performed. An automated drilling tool replacement system will also preferably avoid the loss of control of the drilling tools during a change-out operation, or cause damage to the drilling tools or other parts of the drilling rig.

One type of drilling machine used for drill and blast operations is disclosed in U.S. Pat. No. 5,931,238 issued to Gilmore et al. on Aug. 3, 1999 ("the '238 patent"). The '238 patent discloses a blast hole drill with a drill head mounted on a mast and a pipe carousel on the drill deck. A drill pipe handling system includes an arm assembly that transfers a drill pipe from a position on a pipe carousel to a position adjacent the mast. The arm assembly includes a single jaw pipe grasping assembly and a double jaw grasping assembly to hold a drill pipe as it is transferred by the arm assembly.

While the drilling machine of the '238 patent may be useful for some drilling purposes, the '238 patent does not disclose a pipe management system that ensures against damage or loss of control of the drilling tools during drilling tool change-out operations. In addition, the drill pipe handling system disclosed in the '238 patent may be unduly complicated and adapted only to drilling machines where drill pipes are stored in horizontal position on the deck. Furthermore, the drill pipe handling system disclosed in the '238 patent requires a substantial amount of space in order to manipulate between a pipe loading and pipe storage position. Moreover, the system of the '238 patent is not suitable for drilling rigs where individual pipe loaders are provided for performing the automatic drilling tool change-out operations rather than a pipe carousel.

The drilling tool replacement control system and method of the present disclosure solves one or more of the problems set forth above and/or other problems of the prior art.

SUMMARY

In one aspect, the present disclosure is directed to a pipe loading system for a blast hole drilling rig, wherein the blast hole drilling rig includes a drilling platform, a drill tower supported on the drilling platform, a drill motor supported at an upper end of the drill tower, operatively coupled to a drilling head configured to selectively engage with and rotate a drill pipe, and at least one pipe loader pivotably supported on the drilling rig and configured to selectively index a drilling tool into coaxial alignment with the drill pipe during a drilling tool change-out operation. The at least one pipe loader may include a pipe support pod disposed at a lower end of the at least one pipe loader and a pipe holding clamp disposed at an upper end of the at least one pipe loader. One or more sensors included on the drilling rig may be configured to detect one or more of a presence of the drilling tool in the at least one pipe holder, an interconnection between the drilling head and the drill pipe, and a state of the pipe holding clamp. The pipe loading system may be configured to determine whether the drilling tool is in the at least one pipe loader, determine a state of the pipe holding clamp, and close the pipe holding clamp when the drilling tool is detected in the at least one pipe loader and the pipe holding clamp is not in a closed position.

In another aspect, the present disclosure is directed to a pipe loading system for a blast hole drilling rig. The blast hole drilling rig includes a drilling platform, a drill tower supported on the drilling platform, a drill motor supported at an upper end of the drill tower, operatively coupled to a drilling head configured to selectively engage with and rotate a drill pipe, and at least one pipe loader pivotably supported on the drilling rig and configured to selectively index a drilling tool into coaxial alignment with the drill pipe during a drilling tool change-out operation. The at least one pipe loader may include a vertical beam with a pipe support pod coupled to a lower end of the vertical beam and a pipe holding clamp coupled to an upper end of the vertical beam. One or more sensors on the drilling rig may be configured to detect one or more of a presence of the drilling tool in the at least one pipe holder, an interconnection between the drilling head and the drill pipe, and a state of the pipe holding clamp. The pipe loading system may be configured to determine whether the drilling tool is in the at least one pipe loader, determine the state of the pipe holding clamp, determine whether the drilling head is clear of a path of the at least one pipe loader during the drilling tool change-out operation or whether the at least one pipe loader is in an engaged position swung underneath the drilling head, determine whether the drilling head is engaged with the drill pipe, determine whether the drill pipe is coupled with a drill bit at an opposite end of the drill pipe from the drilling head, and open the pipe holding clamp when the pipe holding clamp is not in an open position, the drilling tool is not detected in the at least one pipe loader, the drilling head is clear of the path of the at least one pipe loader during the drilling tool change-out operation or the at least one pipe holder is engaged, the drilling head is engaged with the drill pipe, and the drill pipe is not coupled with the drill bit.

In yet another aspect, the present disclosure is directed to a method of automatically loading drilling tools on a blast hole drilling rig. The blast hole drilling rig may include a drilling platform, a drill tower supported on the drilling platform, a drill motor supported at an upper end of the drill tower, operatively coupled to a drilling head configured to selectively engage with and rotate a drill pipe, and at least one pipe loader pivotably supported on the drilling rig and configured to selectively index a drilling tool into coaxial alignment with the drill pipe during a drilling tool change-out operation. The at least one pipe loader may include a pipe support pod disposed at a lower end of the at least one pipe loader and a pipe holding clamp disposed at an upper end of the at least one pipe loader. One or more sensors on the drilling rig may be configured to detect one or more of a presence of the drilling tool in the at least one pipe holder, an interconnection between the drilling head and the drill pipe, and a state of the pipe holding clamp. The method may include determining whether the drilling tool is in the at least one pipe loader, determining the state of the pipe holding clamp, and closing the pipe holding clamp when the drilling tool is detected in the at least one pipe loader and the pipe holding clamp is not in a closed position.

DETAILED DESCRIPTION

Figure 1:
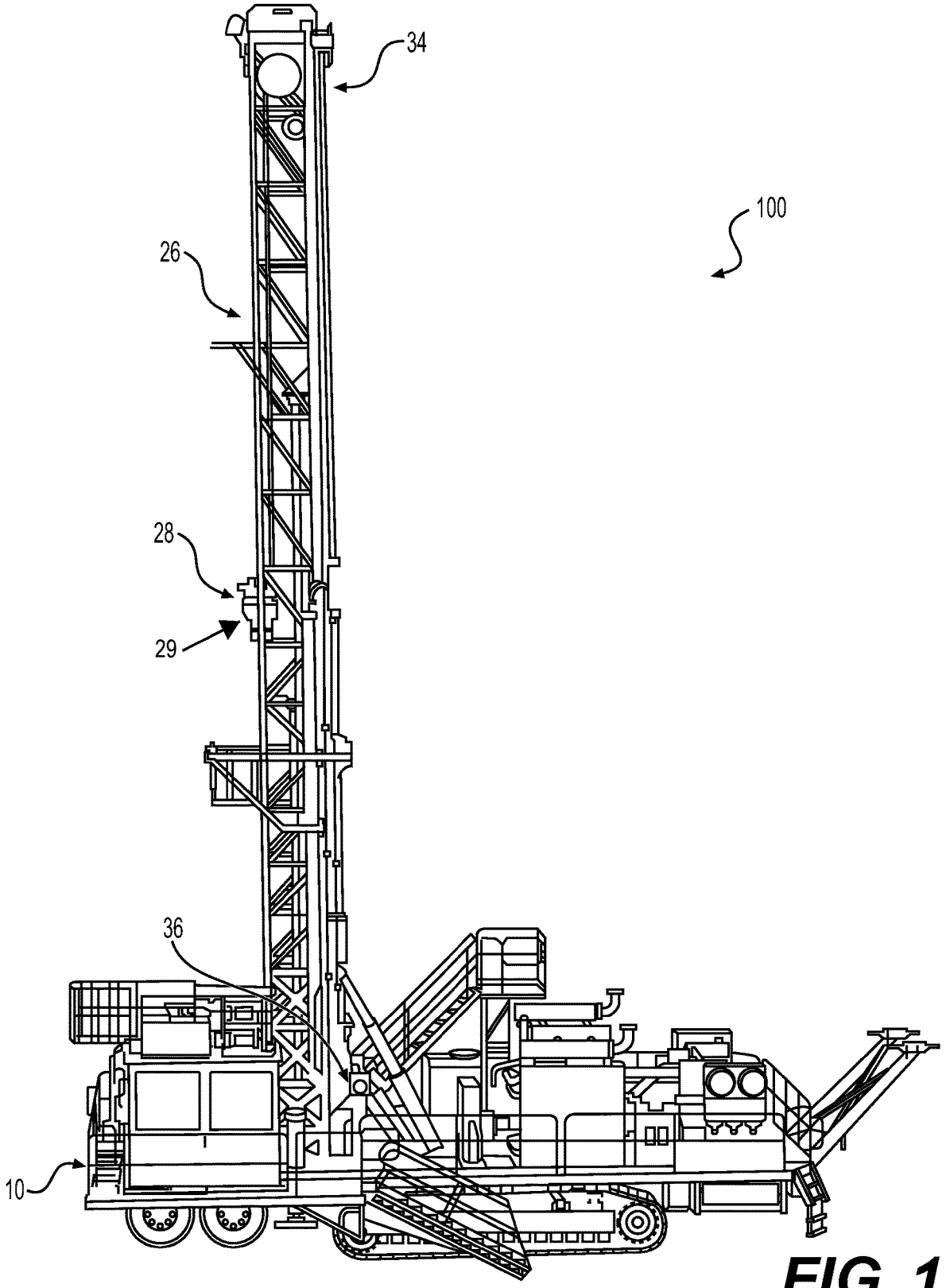
FIG. 1 illustrates an exemplary drilling machine.
Figure 2:
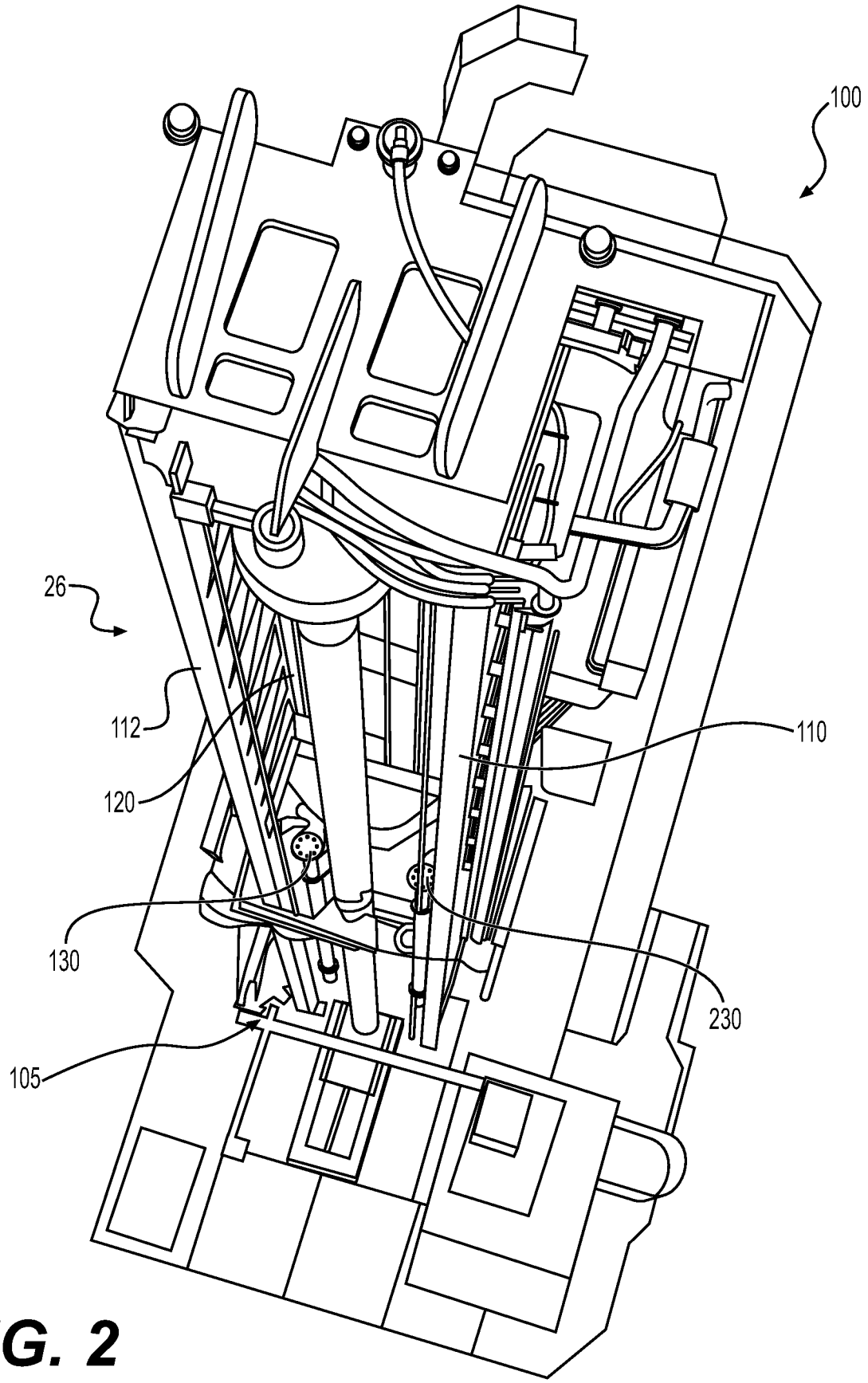
FIG. 2 is a top down view of a drilling tower of an exemplary drilling rig.

FIGS. 1 and 2 illustrate an exemplary drilling rig 100 according to various aspects of the disclosure, including a drill tower (mast) 26 supported on a drill platform 105 at a lower end 36 of drill tower 26, and an operator cab 10. Drilling rig 100 may include tracks, wheels, or other ground engagement members configured for moving drilling rig 100 between sites where holes may be drilled for the placement of blast charges at various depths in substrate to be removed during mining or other earth removal operations. A drill motor 28 may be mounted toward an upper end 34 of drill tower 26 and configured to drive a drill pipe 120 during a blast hole drilling operation.

As shown in FIG. 2, drilling rig 100 may include drill tower 26 constructed on drill platform 105 from a plurality of vertically oriented structural members 110, 112 and other framing and reinforcement members. Hydraulic fluid lines may be routed along drill tower 26 and configured for supplying pressurized hydraulic fluid from a hydraulic pump or other source of pressurized hydraulic fluid to drill motor 28, hydraulic cylinders 140, 240 (see FIG. 4), and/or other devices operated by pressurized hydraulic fluid. Drill motor 28 may be operatively coupled to a drilling head 29 (FIG. 1) configured to selectively engage with and rotate drill pipe 120. The drilling head 29 may be connected at a top end of a drill string including drill pipe 120 for rotation and movement linearly within drill tower 26. The drill string may consist of drill pipe 120 and one or more additional drill extenders such as drill rods or drill pipes (referred to herein as "drilling tools"), which may be in coaxial, threaded engagement with each other. A drill bit 124 or hammer tool may be connected to a bottom end of the drill string at the lower end of drill pipe 120.

Figure 3:
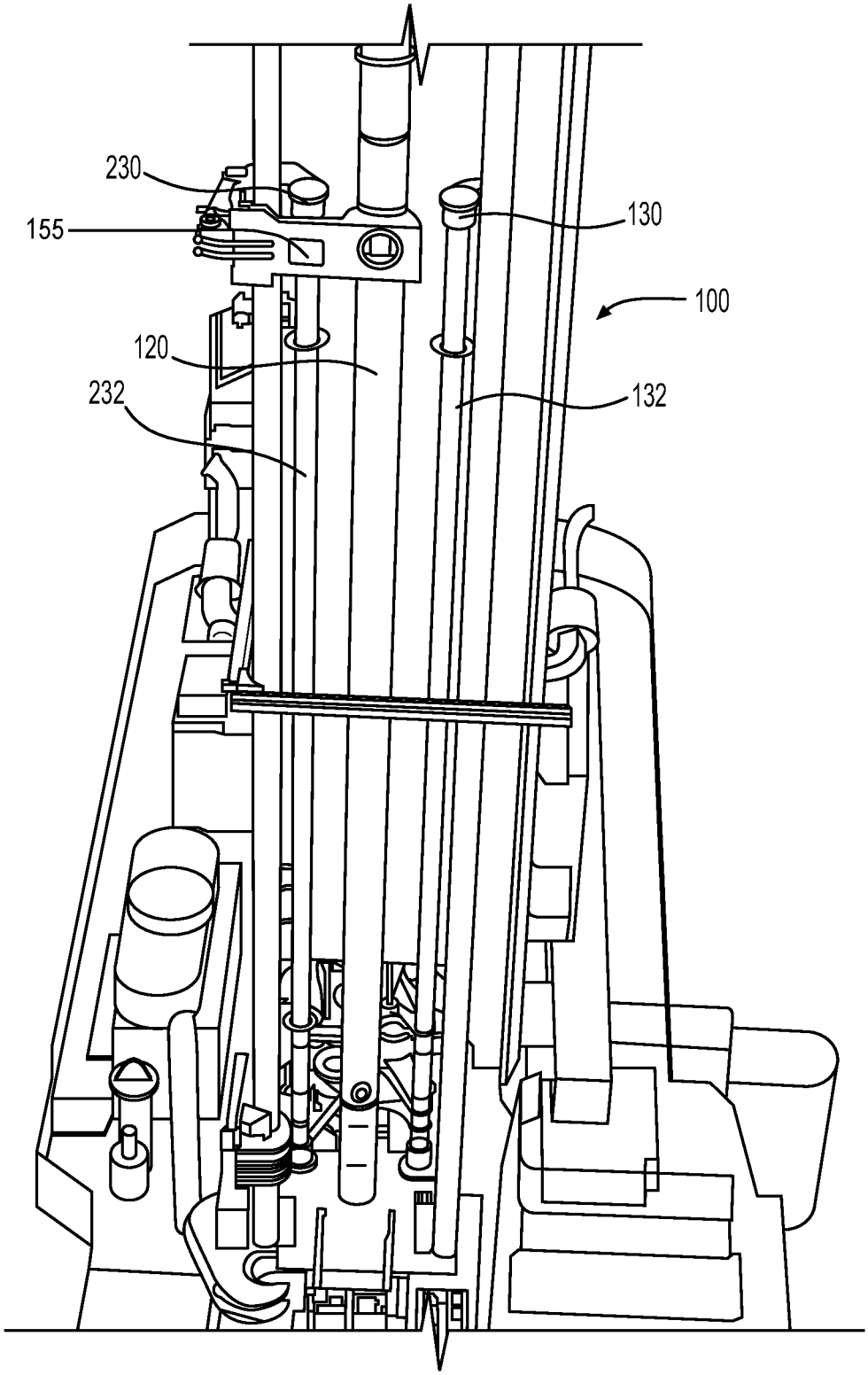
FIG. 3 is a side perspective view of the drilling tower of FIG. 2.
Figure 6:
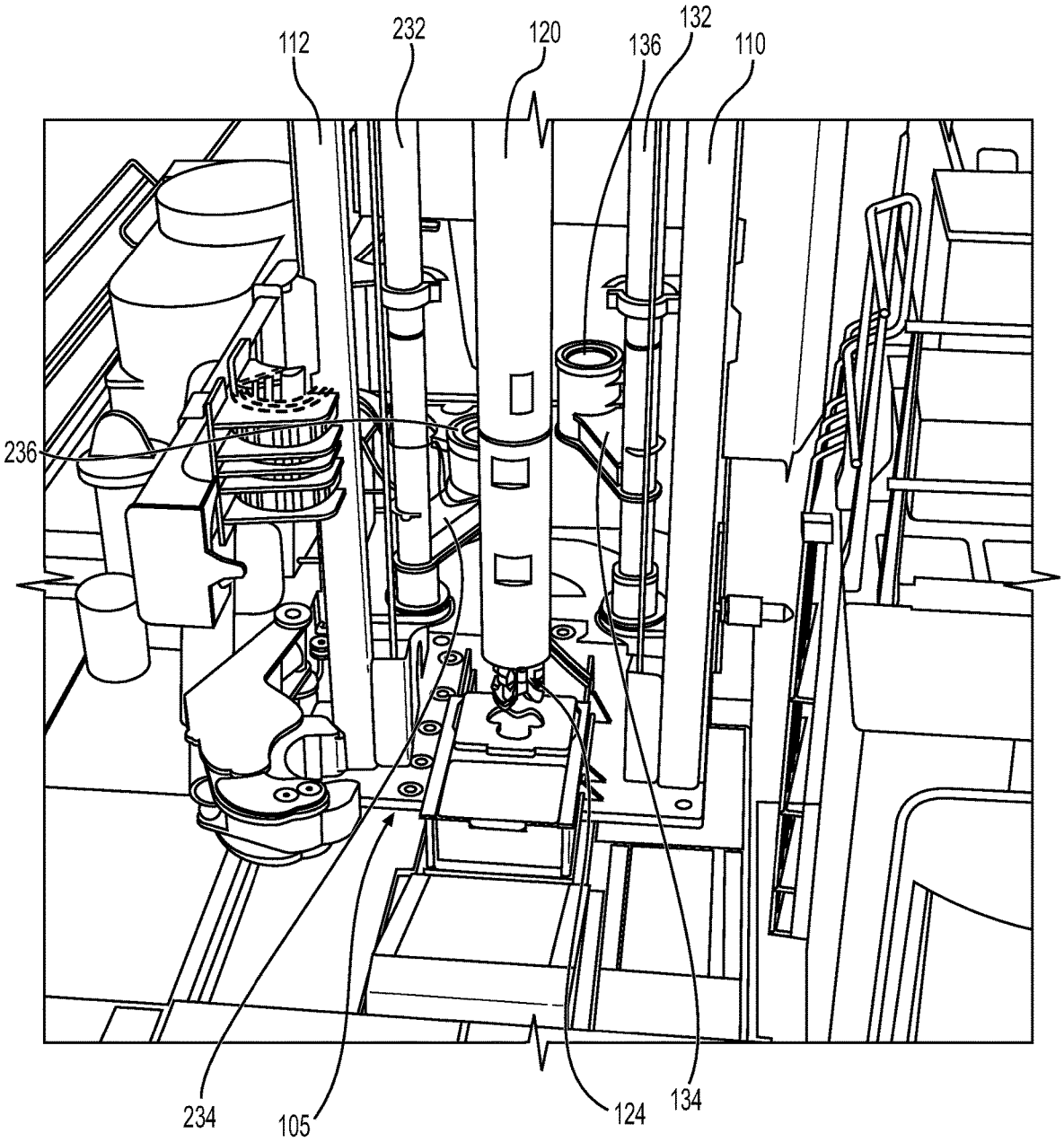
FIG. 6 is a side perspective view of a lower portion of the drilling tower of FIG. 2.

At least one pipe loader may be pivotally supported on drilling rig 100 and configured to selectively index a drilling tool into coaxial alignment with the drill string including drill pipe 120 during a drilling tool change-out operation. In various exemplary embodiments, one or more pipe holders may be pivotably supported on drill platform 105 of drilling rig 100, and/or on portions of drill tower 26 of drilling rig 100. A drilling tool change-out operation may be implemented at any time during use of drilling rig 100 in order to add additional drill extenders to a drill string including drill pipe 120, thus enabling the drilling rig to drill deeper holes into a substrate, or remove drill extenders from a drill string including drill pipe 120 in order to shorten the drill string or for repair or replacement of each drill extender (drilling tool). As best seen in FIGS. 2, 3, and 6, a first pipe loader 130 may be pivotably supported on drill platform 105 and/or pivotably supported on drill tower 26 to one side of drill pipe 120, and a second pipe loader 230 may be pivotably supported on drill platform 105 and/or pivotably supported on drill tower 26 on another side of drill pipe 120. Each pipe loader 130, 230 may be pivotably supported on drill platform 105 and/or drill tower 26 in order to hold and index a drilling tool, such as a length of drill pipe, drill rod, or other drilling tool into coaxial alignment with the drill string including drill pipe 120. Once the drilling tool is moved into coaxial alignment with the drill string by a pipe loader, the drilling tool may be rotated relative to drill pipe 120 in order to effect a threaded engagement with drill pipe 120 or with another drilling tool already threadedly engaged with drill pipe 120. As each drilling tool in a drill string is added to drill pipe 120, the length of the drill string with drill pipe 120 and drill bit 124 at the end may be increased, and as each drilling tool is disconnected from drill pipe 120 and moved away from drill pipe 120 by one of pipe loaders 130, 230, the length of the drill string may be decreased.

Figure 7:
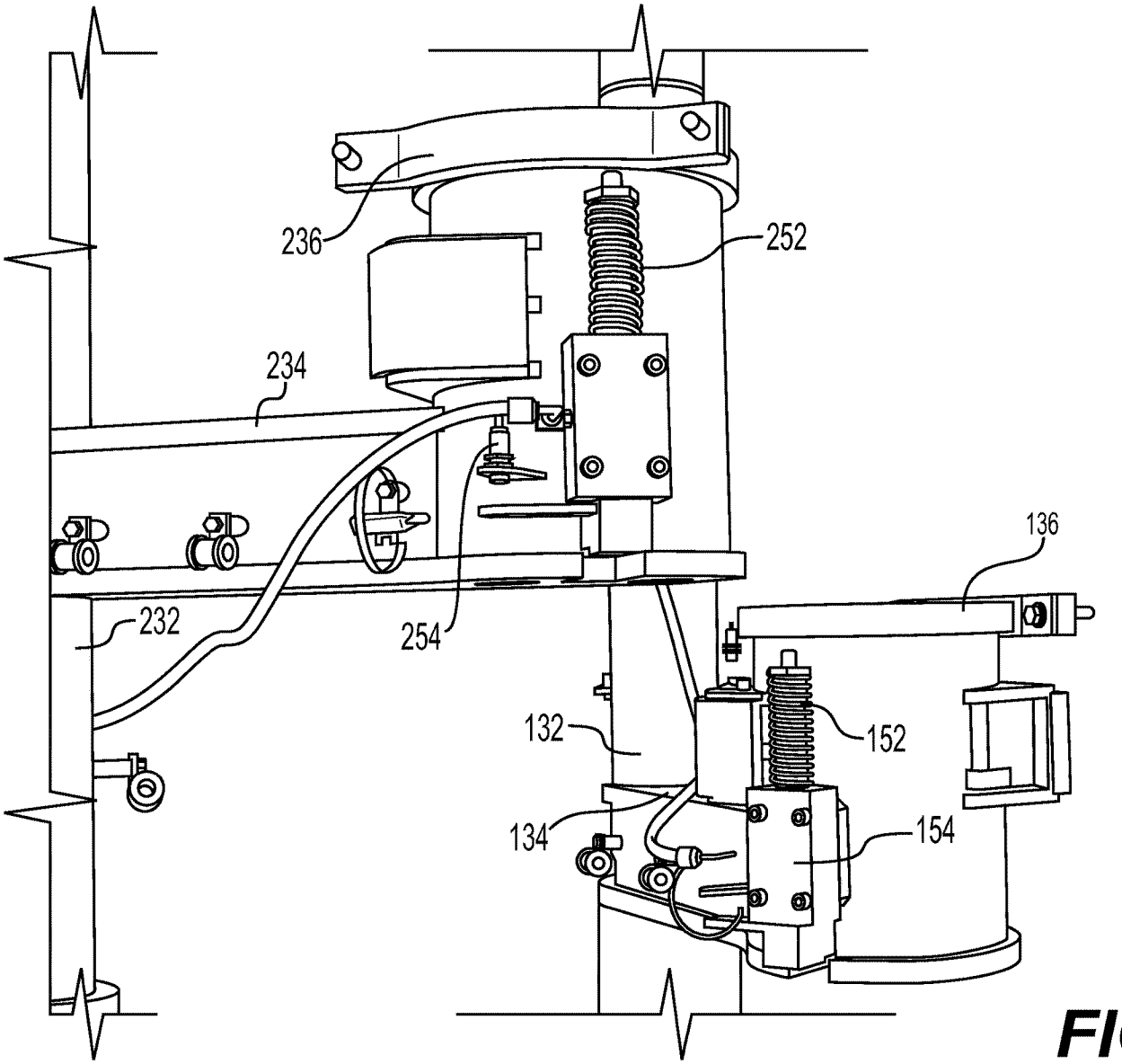
FIG. 7 is a perspective view of the lower pipe support pods on cantilever arms of the pipe loaders on a drilling rig.

As best seen in FIGS. 6 and 7, an exemplary embodiment of drilling rig 100 may include each of pipe loaders 130, 230 pivotably mounted on drill platform 105 and/or drill tower 26, with pipe loader 130 including a vertical beam 132 extending upwardly from drill platform 105, and pipe loader 230 including a vertical beam 232 extending upwardly from drill platform 105. A cantilever arm 134 may extend laterally from a lower, proximal end of vertical beam 132 of pipe loader 130, with a pipe support pod 136 mounted at the distal end of cantilever arm 134. Similarly, a cantilever arm 234 may extend laterally from a lower, proximal end of vertical beam 232 of pipe loader 230, with a second pipe support pod 236 mounted at the distal end of cantilever arm 234. While two pipe loaders are shown, alternative embodiments may only include one pipe loader, or more than two pipe loaders. A pipe loader is referred to as being "engaged" when it is swung in underneath the drilling head 29 (FIG. 1) in order to either load a drilling tool (extender such as a drill pipe or drill rod) or to remove a drilling tool from a drill string. One or more sensors may be configured to generate a signal indicative of a pipe loader being engaged, or swung in underneath the drilling head. In addition, or alternatively, one or more sensors may be configured to generate a signal indicative of the drilling head being positioned such that it is clear of a path followed by the pipe loader as it is engaged and disengaged. In various exemplary embodiments, an automatic pipe loading system according to this disclosure may determine whether a pipe loader is engaged and/or whether the drilling head is clear of a path followed by the pipe loader as it is engaged and disengaged. A determination that a pipe loader is engaged (swung underneath the drilling head), and/or a determination that the drilling head is clear of a path followed by the pipe loader when it is being engaged or disengaged may be conditions that are met before opening a pipe holding clamp of a pipe loader.

Figure 4:
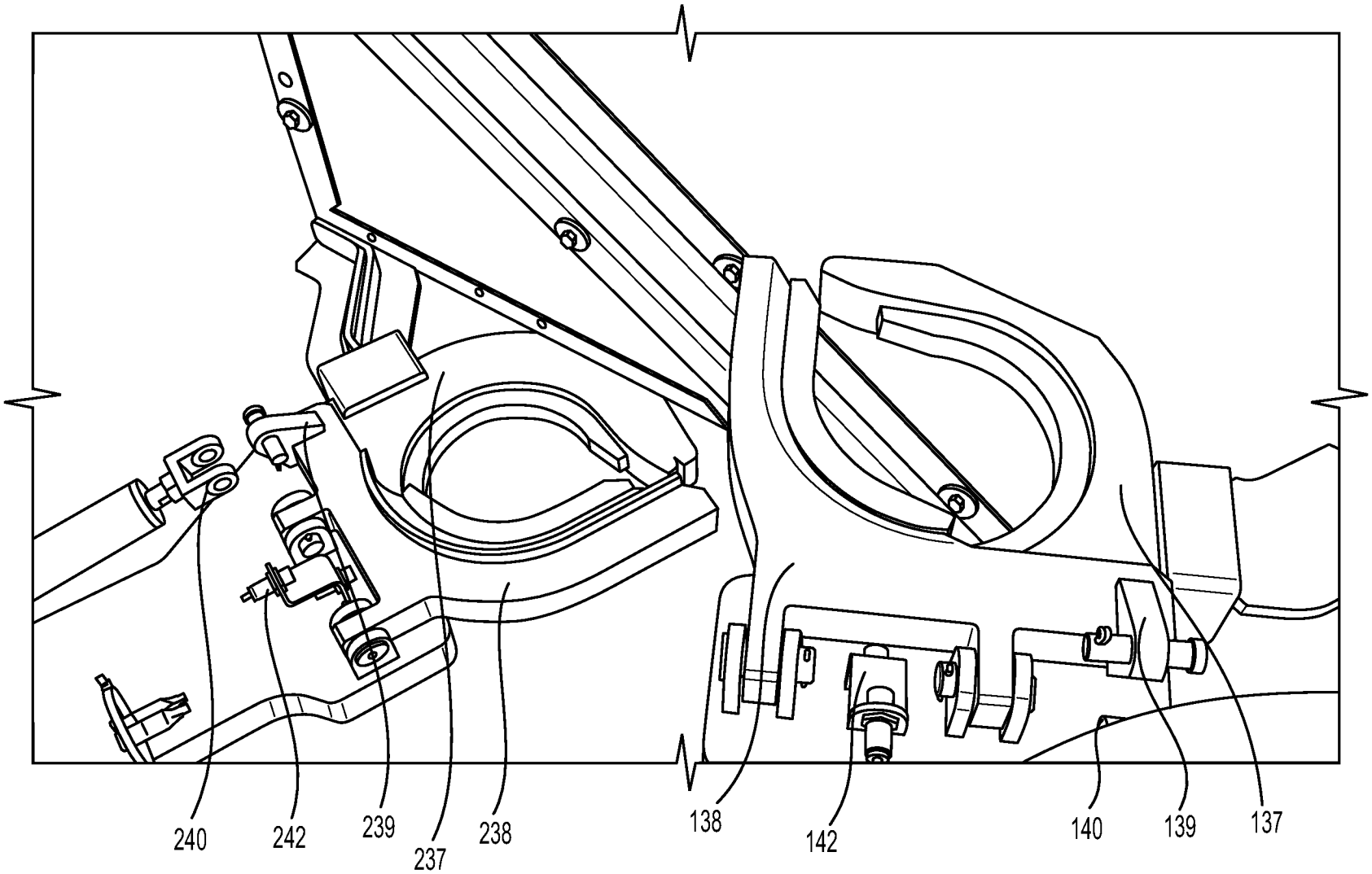
FIG. 4 is a perspective view of pipe holding clamps of pipe loaders on a drilling rig.
Figure 5:
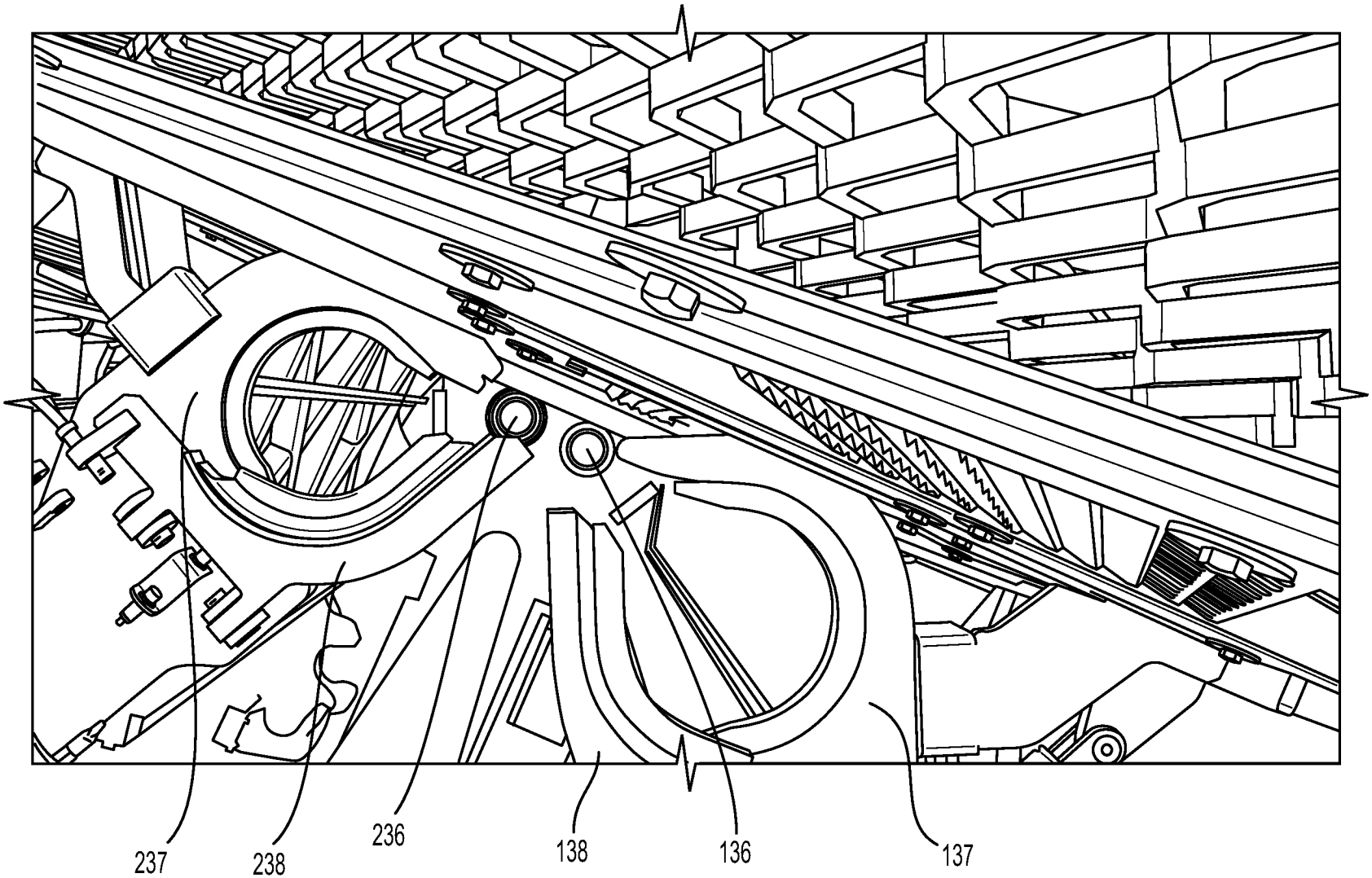
FIG. 5 is a top down view of the pipe holding clamps of pipe loaders on a drilling rig.

As shown in FIGS. 4 and 5, each pipe loader 130, 230 may also include a pipe holding clamp at a top, distal end of vertical beam 132, 232. The pipe holding clamp for pipe holder 130 may include a pipe clamp first member 137 and a pivotal gate member 138. Similarly, the pipe holding clamp for pipe holder 230 may include a pipe clamp first member 237 and a pivotal gate member 238. Pivotal gate member 138 of pipe loader 130 may be mounted by a hinge member 139 to a proximal end of pipe clamp first member 137, and a hydraulic cylinder 140 may be connected to pivotal gate member 138 and configured to pivot gate member 138 from a closed position coplanar with pipe clamp first member 137 to an open, vertical position that is orthogonal to pipe clamp first member 137. Similarly, pivotal gate member 238 of pipe loader 230 may be mounted by a hinge member 239 to a proximal end of pipe clamp first member 237, and a hydraulic cylinder 240 may be connected to pivotal gate member 238 and configured to pivot the gate member from a closed position coplanar with pipe clamp first member 237 to an open, vertical position that is orthogonal to pipe clamp first member 237. In the closed positions, such as shown in FIGS. 4 and 5, pipe clamp first members 137, 237 and pivotal gate members 138, 238 are configured to fit around the outer circumference of a drilling tool that is being moved by pipe holder 130, 230, either for installation in a drill string, or for removal from the drill string. Alternative embodiments may configure the pipe holding clamps on the pipe loaders differently than described above. For example, a pivotal gate member may be connected to a non-pivoting portion of the pipe holding clamp in a manner that allows the pivotal gate member to be pivoted in a horizontal direction away from the non-pivoting portion rather than in a vertical direction. In still further alternative embodiments, pipe holding clamp portions may pivot relative to each other. In some embodiments, the inner circumferential portions of the pipe holding clamps may be lined with a material, such as an elastomeric material, in order to protect the drilling tool that is help by each pipe clamp.

Alternative embodiments of pipe loaders 130, 230 may not require vertical beams 132, 232 extending between a lower pipe support pod and an upper pipe holding clamp. For example, pipe support pod 136 of pipe loader 130 may be mounted at a distal end of cantilever arm 134, and cantilever arm 134 may be pivotally supported directly on drill platform 105, while a pipe holding clamp including pipe clamp first member 137 and pivotal gate member 138 may be pivotally supported on drill tower 26 a vertically spaced distance above pipe support pod 136, and controlled electronically to pivot in synchronization and vertical alignment with pivotal movement of pipe support pod 136 such that the pipe holding clamp is always positioned vertically above pipe support pod 136. Similarly, pipe support pod 236 of pipe loader 230 may be mounted at a distal end of cantilever arm 234 pivotally supported on drill platform 105, while a pipe holding clamp including pipe clamp member 237 and pivotal gate member 238 may be pivotally supported on drill tower 26 a vertically spaced distance above pipe support pod 236, and controlled electronically to pivot in synchronization and vertical alignment with pivotal movement of pipe support pod 236 such that the pipe holding clamp is always positioned vertically above pipe support pod 236. In this manner, each pipe loader 130, 230 may hold and index a drilling tool, such as a length of drill pipe, drill rod, or other drilling tool into or out of coaxial alignment with drill pipe 120 and the drilling head 29, as the drilling tool is added to the drill string or removed from the drill string for replacement or repair. When a drilling tool is positioned in coaxial alignment with drill pipe 120 and the drilling head 29 or another drilling tool of a drill string, the drilling tool may be rotated relative to drill pipe 120 or another drilling tool that is already part of the drill string in order to effect a threaded engagement of the drilling tool and drill pipe 120 or other drilling tool of the drill string.

One or more sensors may be configured to detect one or more of a presence of a drilling tool in either one of pipe holders 130, 230, an interconnection between the drilling head 29 and drill pipe 120 or another drilling tool in a drill string, and a state of each of the pipe holding clamps of pipe holders 130, 230 (i.e., whether a pipe holding clamp is in an opened or closed position); FIG. 3 depicts a sensor 155. As shown in FIG. 4, pipe loader 130 may include a proximity sensor 142 mounted on pipe clamp first member 137 adjacent the hinged connection between pipe clamp first member 137 and pivotal gate member 138. As gate member 138 is pivoted vertically to move the pipe holding clamp into an open configuration, or to close the pipe clamp around a drill pipe or other drilling tool, proximity sensor 142 may be configured to provide a signal indicative of the pipe holding clamp being either in a closed position or an open position. Similarly, a proximity sensor 242 may be mounted on pipe clamp first member 237 adjacent the hinged connection between pipe clamp first member 237 and pivotal gate member 238. As gate member 238 is pivoted vertically in order to close the pipe clamp around a drill pipe or other drilling tool, proximity sensor 242 may be configured to provide a signal indicative of the pipe holding clamp being either in a closed position or an open position. Alternative embodiments may include other means of detecting the pipe holding clamp positions. For example, one or more hydraulic cylinders, such as hydraulic cylinders 140, 240 configured for pivoting gate members 138, 238, may include in-cylinder position sensors. Such in-cylinder position sensors may be configured to produce signals indicative of an amount of movement of a cylinder piston or rod, and a controller may receive those signals and translate the signals into an indication of the state of the pipe holding clamp gate members—such as being in an opened position, closed position, or some other position.

Figure 8:
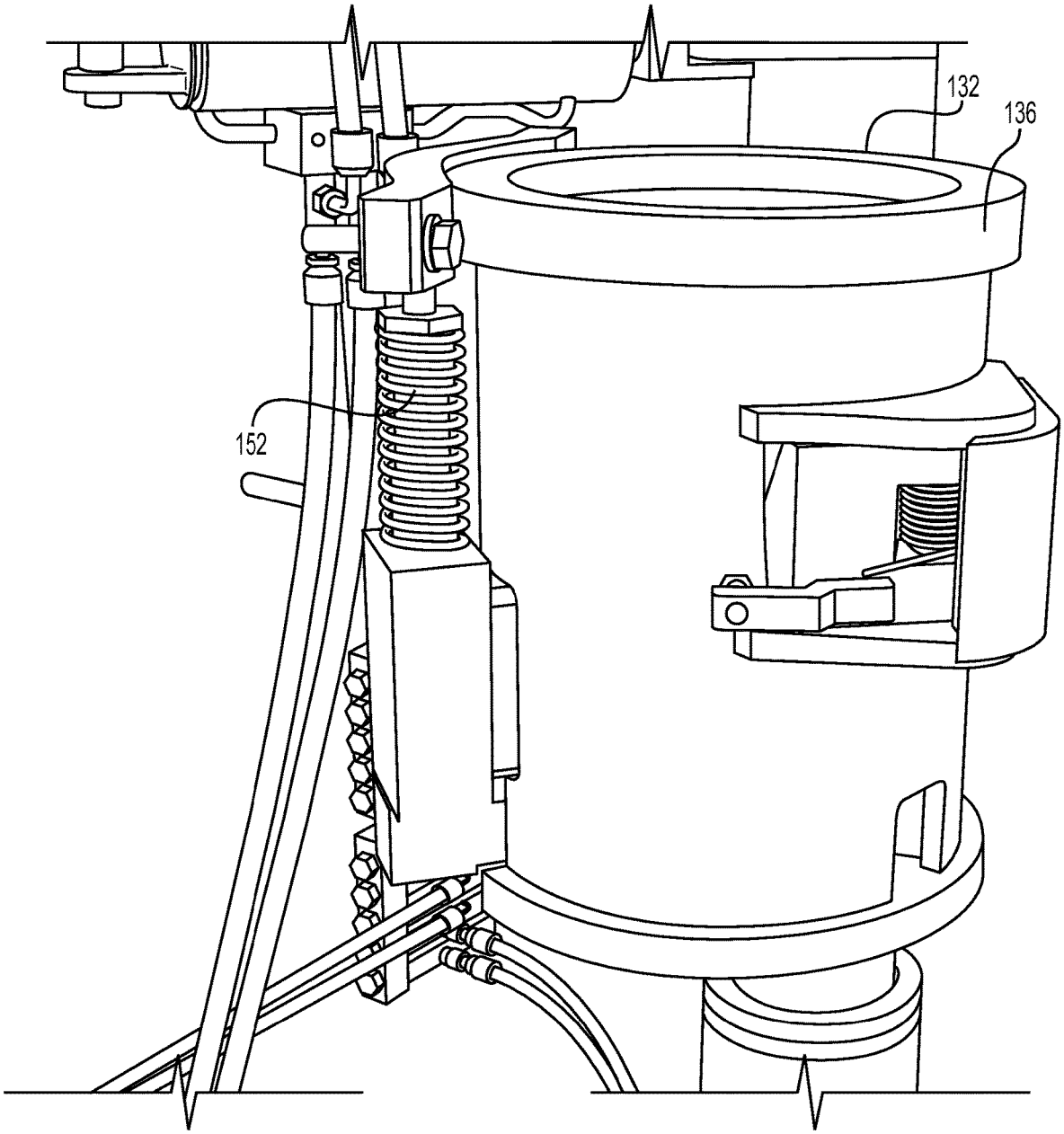
FIG. 8 is a side perspective view of a lower pipe support pod of a pipe loader on a drilling rig.
Figure 9:
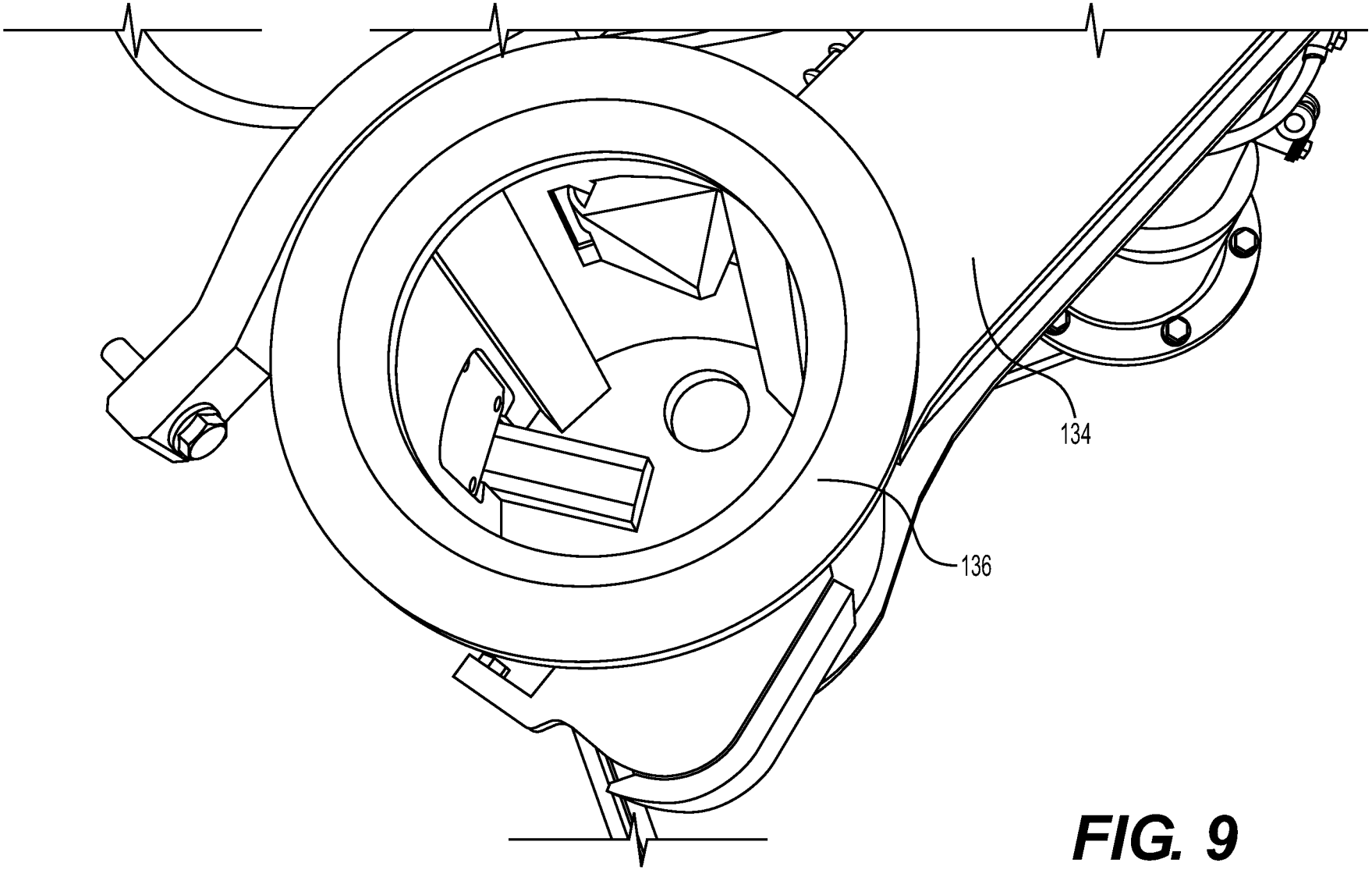
FIG. 9 is a top down perspective view of a lower pipe support pod of a pipe loader on a drilling rig.

Referring to FIGS. 7, 8, and 9, pipe support pod 136 at a lower end of pipe loader 130, and pipe support pod 236 at a lower end of pipe loader 230 may also be configured with proximity sensors 154, 254 configured to generate signals indicative of a drilling tool being present in the respective pipe support pods. For example, when a drilling tool is positioned in pipe support pod 136, the weight of the drilling tool may move pipe support pod 136 downwardly against a biasing force of a pod biasing mechanism 152. A proximity sensor 154 may be configured to detect this movement and generate a signal indicative of the presence of a drilling tool in pipe support pod 136 of pipe loader 130. Similarly, when a drilling tool is positioned in pipe support pod 236, the weight of the drilling tool may move pipe support pod 236 downwardly against a biasing force of a pod biasing mechanism 252. A proximity sensor 254 may be configured to detect this movement and generate a signal indicative of the presence of a drilling tool in pipe support pod 236 of pipe loader 230. In various alternative embodiments, redundant proximity sensors may be provided in association with each pipe support pod 136, 236, and in some cases one proximity sensor may generate a signal when a pipe is present in the pipe support pod, while another sensor may generate a signal when a pipe is not present in the pod. Additionally, or alternatively, both sensors may be configured to generate signals when a pipe is either present or not present, and a lack of consistency between the signals of the two proximity sensors may result in generation of a diagnostic or event code sent to an operator, thus providing the operator with information that may be used to decide whether to override the automatic operations and switch to manual operations. In addition to the above-described proximity sensors, additional sensors and/or switches on drilling tower 26 may be configured to generate signals indicative of the pipe loader 130 being engaged, pipe loader 230 being engaged, the drilling head 29 (FIG. 1) being moved to a position that is clear of the paths followed by the pipe loaders, an interconnection between the drilling head 29 and drill pipe 120 or other drilling tool of a drill string that includes drill pipe 120, an interconnection between drill pipe 120 and drill bit 124, a velocity at which the drilling head 29 is being rotated, and other operational and safety characteristics during a drilling operation or during a drilling tool change-out operation.

Drilling operations involving drilling rig 100 may include many complex operations and the generation of data from different sensors, switches, gauges, and other monitoring devices that must be monitored and acted upon by a drilling rig operator. As a result, an automatic control system according to various aspects of this disclosure may be configured to receive data from the various sensors, switches, gauges, and other monitoring devices and automatically control activation and movement of the pipe loaders and the pipe holding clamps on each of the pipe loaders. The automatic control system may be configured to control opening and closing of pipe holding clamp gate members 138, 238, and movement of pipe holders 130, 230 to avoid any accidental collisions between any of the moving parts during drilling tool change-out operations, dropping of a drilling tool, or other problems during operation of drilling rig 100.

In one exemplary embodiment of an automatic pipe loading system according to this disclosure, an automatic control system may be configured to determine whether a drilling tool is in at least one of the pipe loaders, determine the state of the pipe holding clamp, such as whether the pipe holding clamp is in an open position, a closed position, or somewhere in between, and close the pipe holding clamp when the drilling tool is detected in the at least one pipe loader and the pipe holding clamp is not in a closed position. This particular control strategy covers a situation where it is necessary to close a pipe holding clamp pivotal gate member on a pipe loader to allow movement of the pipe loader before adding a drilling tool to a drill string. Additionally, this control strategy ensures that a pipe holding clamp gate member is closed when parking a pipe loader containing a drilling tool. The control strategy ensures that the pipe holding clamp is closed when the drilling tool is in the pipe loader, even if the pipe holding clamp is in a partially, but not completely closed state.

In another exemplary embodiment of the automatic pipe loading system according to this disclosure, an automatic control system may be configured to determine whether the drilling head of the drilling rig is clear of a path of the at least one pipe loader during a drilling tool change-out operation or whether the at least one pipe loader is in an engaged position swung underneath the drilling head, determine whether the drilling head is engaged with the drill pipe or other drilling tool of a drill string, determine whether the drill pipe is coupled with a drill bit at an opposite end of the drill pipe from the drilling head, and open the pipe holding clamp when the pipe holding clamp is not in an open position, the drilling tool is not detected in the at least one pipe loader, the drilling head is clear of the path of the at least one pipe loader or the at least one pipe loader is engaged, the drilling head is engaged with the drill pipe or other drilling tool of the drill string, and the drill pipe is not coupled with the drill bit. This particular control strategy covers a situation when a pipe holding clamp gate member is to be opened to allow parking of an empty pipe loader after connecting a drill pipe or other drilling tool of a drill string to the drilling head. Additionally, this control strategy allows for removal of a drill pipe or other drilling tool from a drill string and storing of that drill pipe or drilling tool in the pipe loader. Moreover, this control strategy ensures that the pipe holding clamp is moved to the fully opened position after determining that the above-described conditions are met, even if the pipe holding clamp is in a partially, but not completely opened state.

INDUSTRIAL APPLICABILITY

A method of automatically loading drilling tools such as drill pipe, drill rod, or other drilling extenders onto a blast hole drilling rig according to various aspects of this disclosure may reduce the possibility of damage to the rig or problems such as accidentally dropping a drilling tool during drilling tool change-out operations. A blast hole drilling rig may include a drilling platform, a drill tower supported on the drilling platform, a drill motor supported at an upper end of the drill tower, operatively coupled to a drilling head configured to selectively engage with and rotate a drill pipe or drilling tool of a drill string including the drill pipe, and at least one pipe loader pivotably supported on the drilling rig and configured to selectively index a drilling tool into coaxial alignment with the drill pipe during a drilling tool change-out operation. The at least one pipe loader may include a vertical beam with a pipe support pod coupled to a lower end of the vertical beam and a pipe holding clamp coupled to an upper end of the vertical beam. The pipe holding clamp may include a first portion configured to extend part way around a first circumferential portion on one side of the drilling tool, and a pivotal gate portion. The pivotal gate portion may be configured to pivot between a closed position in which the gate portion is coplanar with the first portion and extends part way around a second circumferential portion on an opposite side of the drilling tool, to an open position in which the gate portion is rotated to a vertical position to open the pipe holding clamp.

The drilling rig may also include one or more sensors, switches, gauges, or other monitoring devices configured to detect, among other things, one or more of a presence of the drilling tool in the at least one pipe holder, an interconnection between the drilling head and the drill pipe, and a state of the pipe holding clamp. An exemplary implementation of the method of automatically loading drilling tools may be performed by an automatic control system according to various aspects of this disclosure. The automatic control system may receive data from the various sensors, switches, gauges, and other monitoring devices and automatically control activation and movement of the pipe loaders and the pipe holding clamps on each of the pipe loaders. For example, in one exemplary implementation, the automatic control system may control opening and closing of pipe holding clamp gate members 138, 238, described above, and movement of pipe holders 130, 230 to avoid any accidental collisions between any of the moving parts during drilling tool change-out operations, dropping of a drilling tool, or other problems during operation of drilling rig 100.

The automatic pipe loading system may determine whether the drilling tool is in the at least one pipe loader, determine the state of the pipe holding clamp, determine whether the drilling head is clear of a path of the at least one pipe loader during the drilling tool change-out operation or whether the at least one pipe loader is in an engaged position swung underneath the drilling head, determine whether the drilling head is engaged with the drill pipe, determine whether the drill pipe is coupled with a drill bit at an opposite end of the drill pipe from the drilling head, and open the pipe holding clamp when the pipe holding clamp is not in a fully opened state, the drilling tool is not detected in the at least one pipe loader, the drilling head is clear of the path of the at least one pipe loader during the drilling tool change-out operation or the at least one pipe loader is in the engaged position, the drilling head is engaged with the drill pipe, and the drill pipe is not coupled with the drill bit. The automatic pipe loading system according to various exemplary implementations of this disclosure may also close the pipe holding clamp when the drilling tool is detected in the at least one pipe loader and the pipe holding clamp is not in a fully closed position.

In some exemplary implementations, the automatic pipe loading system may control two pipe loaders pivotably supported on the drilling platform, each of the pipe loaders being configured to alternately and selectively index a drilling tool into coaxial alignment with the drill pipe or drill string and the drilling head during a drilling tool change-out operation. The automatic pipe loading system may determine whether the drilling head is clear of paths followed by the two pipe loaders during the drilling tool change-out operation or whether one of the pipe loaders is in an engaged position swung underneath the drilling head, determine whether the drilling head is engaged with the drill pipe, determine whether the drill pipe is coupled with a drill bit at an opposite end of the drill pipe from the drilling head, and when the pipe holding clamp of either one of the two pipe loaders is not in a fully opened position, the drilling tool is not detected in the pipe loader with the pipe holding clamp in a closed position, the drilling head is clear of the path of the pipe loader or one of the pipe loaders is in the engaged position swung underneath the drilling head, the drilling head is engaged with the drill pipe, and the drill pipe is not coupled with the drill bit, open the pipe holding clamp.

A method of automatically loading drilling tools on a blast hole drilling rig according to various exemplary implementations of this disclosure may include determining whether the drilling tool is in the at least one pipe loader, determining the state of the pipe holding clamp, closing the pipe holding clamp when the drilling tool is detected in the at least one pipe loader and the pipe holding clamp is not in a closed position, determining whether the drilling head is clear of a path of the at least one pipe loader during the drilling tool change-out operation or whether the at least one pipe loader is in an engaged position swung underneath the drilling head, determining whether the drilling head is engaged with the drill pipe, determining whether the drill pipe is coupled with a drill bit at an opposite end of the drill pipe from the drilling head, and opening the pipe holding clamp when the pipe holding clamp is not in a fully opened position, the drilling tool is not detected in the at least one pipe loader, the drilling head is clear of the path of the at least one pipe loader or the at least one pipe loader is in the engaged position, the drilling head is engaged with the drill pipe, and the drill pipe is not coupled with the drill bit.

It will be apparent to those skilled in the art that various modifications and variations can be made in the disclosed drilling rig and automatic pipe loading system without departing from the scope of the disclosure. Other embodiments of the disclosed drilling rig and automatic pipe loading system will be apparent to those skilled in the art from consideration of the specification. It is intended that the specification and examples be considered as exemplary only, with a true scope of the disclosure being indicated by the following claims and their equivalents.

What is claimed is:

1. A pipe loading system for a blast hole drilling rig, wherein the blast hole drilling rig comprises a drilling platform, a drill tower supported on the drilling platform, a drill motor supported at an upper end of the drill tower, operatively coupled to a drilling head configured to selectively engage with and rotate a drill pipe, and at least one pipe loader pivotably supported on the drilling rig and configured to selectively index a drilling tool into coaxial alignment with the drill pipe during a drilling tool change-out operation, wherein the at least one pipe loader comprises a pipe support pod disposed at a lower end of the at least one pipe loader and a pipe holding clamp disposed at an upper end of the at least one pipe loader, and one or more sensors configured to detect one or more of a presence of the drilling tool in the at least one pipe holder, an interconnection between the drilling head and the drill pipe, and a state of the pipe holding clamp, the pipe loading system being configured to:

determine whether the drilling tool is in the at least one pipe loader;

determine the state of the pipe holding clamp; and close the pipe holding clamp when the drilling tool is detected in the at least one pipe loader and the pipe holding clamp is not in a closed position.

2. The pipe loading system of claim 1, wherein the pipe loading system is further configured to:

determine whether the drilling head is clear of a path of the at least one pipe loader during the drilling tool change-out operation or whether the at least one pipe loader is in an engaged position swung underneath the drilling head;

determine whether the drilling head is engaged with the drill pipe;

determine whether the drill pipe is coupled with a drill bit at an opposite end of the drill pipe from the drilling head; and open the pipe holding clamp when the pipe holding clamp is not in a fully opened state, the drilling tool is not detected in the at least one pipe loader, the drilling head is clear of the path of the at least one pipe loader or the at least one pipe loader is in the engaged position, the drilling head is engaged with the drill pipe, and the drill pipe is not coupled with the drill bit.

3. The pipe loading system according to claim 1, wherein there are two pipe loaders pivotably supported on the drilling platform, each of the pipe loaders being configured to alternately and selectively index a drilling tool into coaxial alignment with the drill pipe during a drilling tool change-out operation, the pipe loading system being further configured to:

determine whether the drilling head is clear of paths followed by the two pipe loaders during the drilling tool change-out operation or whether at least one of the two pipe loaders is in an engaged position swung underneath the drilling head;

determine whether the drilling head is engaged with the drill pipe;

determine whether the drill pipe is coupled with a drill bit at an opposite end of the drill pipe from the drilling head; and when the pipe holding clamp of either one of the two pipe loaders is not in a fully opened state, the drilling tool is not detected in the pipe loader, the drilling head is clear of the path of the pipe loader or the pipe loader is in the engaged position, the drilling head is engaged with the drill pipe, and the drill pipe is not coupled with the drill bit, open the pipe holding clamp.

4. The pipe loading system of claim 1, wherein there are two pipe loaders pivotably supported on the drilling platform.

5. The pipe loading system of claim 1, wherein the one or more sensors includes a proximity sensor configured to detect when the drilling tool is present in the pipe support pod of the at least one pipe loader.

6. The pipe loading system of claim 1, wherein the one of more sensors includes a proximity sensor configured to detect when the pipe holding clamp is in a closed position.

7. The pipe loading system of claim 1, wherein the pipe holding clamp comprises a first portion configured to extend part way around a first circumferential portion on one side of the drilling tool, and a pivotal gate portion configured to be pivoted between a closed position in which the gate portion is coplanar with the first portion and extends part way around a second circumferential portion on an opposite side of the drilling tool, to an open position in which the gate portion is rotated to a vertical position.

8. The pipe loading system according to claim 1, wherein the at least one pipe loader is configured to selectively index a series of drilling tools into coaxial alignment with the drill pipe during consecutive drilling tool change-out operations to increase a total length of a drill string formed by the series of drilling tools and the drill pipe.

9. The pipe loading system according to claim 8, wherein the at least one pipe loader is configured to successively remove drilling tools from the drill string as the drilling tools become worn and require replacement.

10. A pipe loading system for a blast hole drilling rig, wherein the blast hole drilling rig comprises a drilling platform, a drill tower supported on the drilling platform, a drill motor supported at an upper end of the drill tower, operatively coupled to a drilling head configured to selectively engage with and rotate a drill pipe, and at least one pipe loader pivotably supported on the drilling rig and configured to selectively index a drilling tool into coaxial alignment with the drill pipe during a drilling tool change-out operation, wherein the at least one pipe loader comprises a vertical beam with a pipe support pod coupled to a lower end of the vertical beam and a pipe holding clamp coupled to an upper end of the vertical beam, and one or more sensors configured to detect one or more of a presence of the drilling tool in the at least one pipe holder, an interconnection between the drilling head and the drill pipe, and a state of the pipe holding clamp, the pipe loading system being configured to:

determine whether the drilling tool is in the at least one pipe loader;

determine the state of the pipe holding clamp;

determine whether the drilling head is clear of a path of the at least one pipe loader during the drilling tool change-out operation or whether the at least one pipe loader is in an engaged position swung underneath the drilling head;

determine whether the drilling head is engaged with the drill pipe;

determine whether the drill pipe is coupled with a drill bit at an opposite end of the drill pipe from the drilling head; and open the pipe holding clamp when the pipe holding clamp is not in a fully opened state, the drilling tool is not detected in the at least one pipe loader, the drilling head is clear of the path of the at least one pipe loader during the drilling tool change-out operation or the at least one pipe loader is in the engaged position, the drilling head is engaged with the drill pipe, and the drill pipe is not coupled with the drill bit.

11. The pipe loading system of claim 10, wherein the pipe loading system is further configured to close the pipe holding clamp when the drilling tool is detected in the at least one pipe loader and the pipe holding clamp is not in a closed state.

12. The pipe loading system of claim 10, wherein there are two pipe loaders pivotably supported on the drilling rig, each of the pipe loaders being configured to alternately and selectively index a drilling tool into coaxial alignment with the drill pipe during a drilling tool change-out operation, and the pipe loading system is further configured to:

determine whether the drilling head is clear of paths followed by the two pipe loaders during the drilling tool change-out operation or whether at least one of the two pipe loaders is in an engaged position swung underneath the drilling head;

determine whether the drilling head is engaged with the drill pipe;

determine whether the drill pipe is coupled with a drill bit at an opposite end of the drill pipe from the drilling head; and when the pipe holding clamp of either one of the two pipe loaders is not in a fully opened state, the drilling tool is not detected in the pipe loader with the pipe holding clamp in a closed position, the drilling head is clear of the path of the pipe loader or the pipe loader is in the engaged position, the drilling head is engaged with the drill pipe, and the drill pipe is not coupled with the drill bit, open the pipe holding clamp.

13. The pipe loading system of claim 10, wherein there are two pipe loaders pivotably supported on the drilling rig.

14. The pipe loading system of claim 10, wherein the one or more sensors includes a proximity sensor configured to detect when the drilling tool is present in the pipe support pod of the at least one pipe loader.

15. The pipe loading system of claim 10, wherein the one of more sensors includes a proximity sensor configured to detect when the pipe holding clamp is in a closed position.

16. The pipe loading system of claim 10, wherein the pipe holding clamp comprises a first portion configured to extend part way around a first circumferential portion on one side of the drilling tool, and a pivotal gate portion configured to be pivoted between a closed position in which the gate portion is coplanar with the first portion and extends part way around a second circumferential portion on an opposite side of the drilling tool, to an open position in which the gate portion is rotated to a vertical position.

17. The pipe loading system according to claim 10, wherein the at least one pipe loader is configured to selectively index a series of drilling tools into coaxial alignment with the drill pipe during consecutive drilling tool change-out operations to increase a total length of a drill string formed by the series of drilling tools and the drill pipe.

18. The pipe loading system according to claim 17, wherein the at least one pipe loader is configured to successively remove drilling tools from the drill string as the drilling tools become worn and require replacement.

19. A method of automatically loading drilling tools on a blast hole drilling rig, wherein the blast hole drilling rig comprises a drilling platform, a drill tower supported on the drilling platform, a drill motor supported at an upper end of the drill tower, operatively coupled to a drilling head configured to selectively engage with and rotate a drill pipe, and at least one pipe loader pivotably supported on the drilling rig and configured to selectively index a drilling tool into coaxial alignment with the drill pipe during a drilling tool change-out operation, wherein the at least one pipe loader comprises a pipe support pod disposed at a lower end of the at least one pipe loader and a pipe holding clamp disposed at an upper end of the at least one pipe loader, and one or more sensors configured to detect one or more of a presence of the drilling tool in the at least one pipe holder, an interconnection between the drilling head and the drill pipe, and a state of the pipe holding clamp, the method comprising:

determining whether the drilling tool is in the at least one pipe loader;

determining the state of the pipe holding clamp; and closing the pipe holding clamp when the drilling tool is detected in the at least one pipe loader and the pipe holding clamp is not in a closed state.

20. The method of claim 19, further comprising:

determining whether the drilling head is clear of a path of the at least one pipe loader during the drilling tool change-out operation or whether the at least one pipe loader is in an engaged position swung underneath the drilling head;

determining whether the drilling head is engaged with the drill pipe;

determining whether the drill pipe is coupled with a drill bit at an opposite end of the drill pipe from the drilling head; and opening the pipe holding clamp when the pipe holding clamp is not in a fully opened state, the drilling tool is not detected in the at least one pipe loader, the drilling head is clear of the path of the at least one pipe loader or the at least one pipe loader is in the engaged position, the drilling head is engaged with the drill pipe, and the drill pipe is not coupled with the drill bit.

* * * * *